US005433010A

United States Patent [19]

Bell

[11] Patent Number: 5,433,010

[45] Date of Patent: Jul. 18, 1995

[54] SELF ALIGNING OPTICAL GUN SIGHT MOUNT WITH ECCENTRIC ADJUSTMENT CAPABILITIES

[76] Inventor: Dennis L. Bell, 1607 11th St., Greeley, Colo. 80631

[21] Appl. No.: 289,525

[22] Filed: Aug. 12, 1994

[51] Int. Cl.[6] ..... F41G 1/387

[52] U.S. Cl. ..... 33/247; 33/248; 33/246

[58] Field of Search ..... 33/245, 247, 248, 246; 42/100, 101

[56] References Cited

U.S. PATENT DOCUMENTS 2,486,002 10/1949 Buehler ..... 33/247
3,007,248 11/1961 Detrich ..... 33/245
3,037,288 6/1962 Detrich et al. ..... 33/245
3,401,460 9/1968 Tellie ..... 33/245
4,776,126 10/1988 Williams ..... 33/245 X

*Primary Examiner*—Alvin Wirthlin

[57] ABSTRACT

A mounting system for optical gun sights comprised of two or more mounting rings each housing eccentric or straight collars supporting the optical sight allowing the optical sight to self center on it axis without binding or deforming the optical sight. The collars, being adjustably eccentric within the ring housing, optionally provide optimal optical alignment of the inner components of the optical sight.

13 Claims, 4 Drawing Sheets

SELF ALIGNING OPTICAL GUN SIGHT MOUNT WITH ECCENTRIC ADJUSTMENT CAPABILITIES

BACKGROUND OF THE INVENTION

The field of the Invention pertains to mounting systems for optical gun sights. Mounting systems are available in various forms and provide means of attaching the optical sight to the gun. The purpose of these mounting systems is to rigidly hold the optical sight in alignment with the axis of the bore of the gun and further allows the sight to be adjusted internally to direct the fired projectile(s) to the point of aim.

Prior art teaches that the vast majority of existing mounting systems appear as an accessory to the gun being mounted along with the exceptional few that portions of the mounting system is integral to the gun being mounted or the optical sight being mounted. The most common of these systems involve two basic members, commonly referred to as mounting rings and mounting bases. The rings are attached to the base and the ring-base combination is then attached to the gun with attach screws in corresponding attach holes in the gun normally at the receiver, frame or barrel. These ring-base assemblies are normally used in combinations of two, one in front of the other in close parallelism with the axis of the gun bore and holding the optical sight at two or more points in close alignment with the tubular embodiment of the optical sight. Some systems provide windage or elevation adjustment capabilities at some point in the mounts while others are permanent and rigid by design and effect.

Disadvantages with prior art lie in the fact that, because of the rigid nature, two or more mounting rings cannot be aligned without causing stress, binding or marring the outer surface of the optical sight. Inherent misalignment in any of the members of the mounting assembly as well as the mounted gun and "stack up" tolerances in the total assembly can combine to compound the stress, binding and disfiguration of the outer body of the optical sight. Misalignment of the attach holes, distorted or bent receivers on guns also greatly contribute to the misalignment. Metal to metal contact between the mounting rings and the optical sight cause cosmetic blemishes reducing the value of and render unpleasant esthetic value to expensive optical sights.

Prior art makes no provision for eliminating the binding effect of the optical sight. There is no provision for a "third member" in the assembly that allows the optical sight to find it's own center and at the same time providing a mechanism for optimum optical adjustment within the same mounting system when two or more distal mounting points are used.

Optical sights are, in fact, most efficient when internal components and lenses are optically centered. Any time the internal adjustments of the optical sight are required to be moved out of the optimum optical path the quality of the image suffers.

Additionally, prior art does not provide a combination of windage, elevation, increased surface contact, anti marring, anti binding, optical centering or extreme distance adjustment into a single mounting system of their own manufacture or one that can be attached to one of several other manufacturers.

SUMMARY OF THE INVENTION

Primarily, the present invention is designed to afford an optical sight mounting system capable of providing optimal optical alignment of the critical internal components in relationship to the axis of the tubular embodiment of the optical sight. This is achieved by means of an eccentric collar, having its bore axis offset in varrying amounts. The eccentric collars are retained within the preferred embodiment by means of a radiused groove formed in the preferred embodiment. The outer surfaces of the eccentric collars are convexly radiused to match, seat and rotate in the groove in the preferred embodiment or mounting ring. The eccentric collar is positioned in the mounting ring as an assembly and these assemblies clamp over the optical sight at two or more locations around and along the optical sight. This semi final assembly then attaches to mounting bases which are fastened to the gun at two or more points which completes the assembly.

By relieving tension on the mounting rings, the eccentric collars can be rotated to direct the optical sight in the desired position. By rotating the eccentric collars around the optical sight in one or more of the mounting assemblies, the user can use infinite combinations of adjustment including zero offset to the axis and perfect parallelism between the axis of the optical sight and the bore axis of the gun. In any position, the eccentric sleeve will self align to the tubular embodiment of the optical sight. The same holds true if the mounting ring is misaligned with it's base. When the desired adjustments are achieved, the mounting ring can then be secured without binding or deforming the optical sight.

The present unique invention is adaptable to other manufacturers mounting bases of similar design.

The nature of the resilient material aids in the gripping effect by superficially forming to the microstructure of the optical sight surface. The surface finish of the optical sight is protected from being blemished by the nature of the collar material as well as the self centering capability by design. Surface area contact is increased by the additional width of the collar over the normal mounting ring width adding greater gripping effect under high recoil.

Eccentric collar offset variations can be selected and combined to give the user the degree of adjustment needed in any practical application including extreme distance shooting without having to use other forms of mountings, shims or bushings.

The object of the present invention is to provide an optical gun sight mounting system that is adaptable to current industry production and that will afford stress free, multi adjustable, anti deforming, and optically centering mounting for optical gun sights.

DETAILED DESCRIPTION OF THE DRAWINGS

Figure 1:
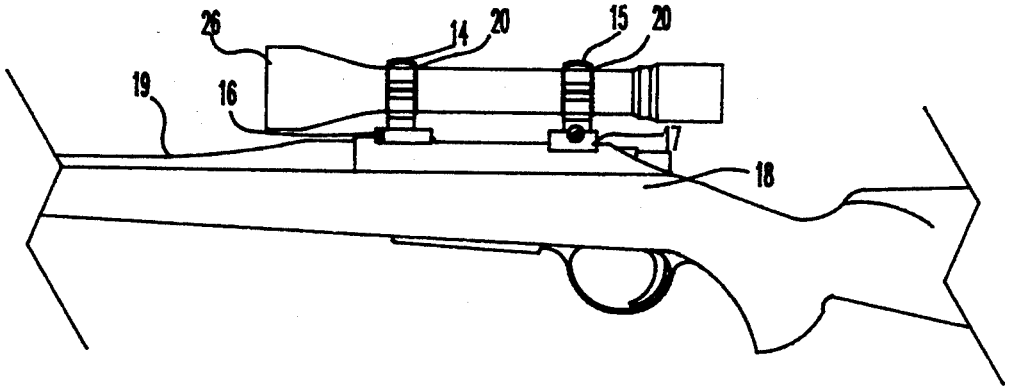
FIG. 1 is a side view of a gun showing a typical optical sight and an optical sight mounting system.

Referring first to FIG. 1 wherein are best shown in relationship to each other, the components of an optically sighted gun 18 with it's barrel 19 and mounting system consisting of a front mount base 16 attached a front mount ring 14 housing a self aligning collar 20 holding an optical sight 26 at the frontal mounting area. A rear mounting area of the optical sight 26 is provided similarly to the frontal area and supported by a rear mounting base 17 attached to a rear mounting ring 15 and housing a self aligning collar 20 holding the rear portion of an optical sight 26.

Figure 2A:
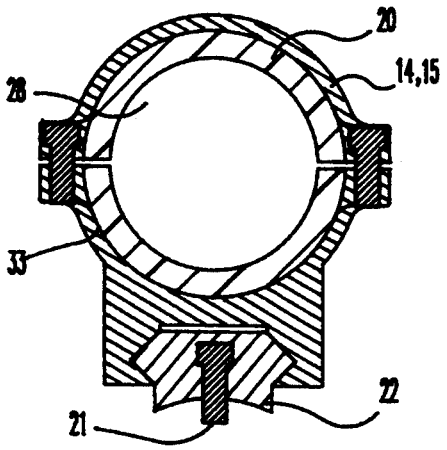
FIG. 2A is a cross sectional view of the present invention as applied to a fixed dovetail form of mounting base with attach screws.
Figure 2B:
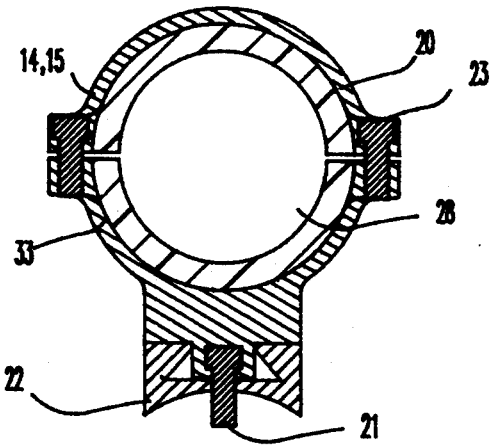
FIG. 2B is a cross sectional view of the present invention as applied to a rotary dovetail form of mounting base with attach screws.

Referring now to FIGS. 2A and 2B wherein is shown in cross section, two common forms of mounting rings 14,15 mounted on respective mounting bases 22 with their mounting screws 21. The upper portion of the mounting rings 14,15 are attached to the lower portion with mounting ring screws 23 which provide clamping force about the self aligning collars 20. The outer diameter of collar is symmetrical to the axis of the bore 28 rendering the collar concentric. The collar portion 20 is two part and together form a unit.

Figure 3A:
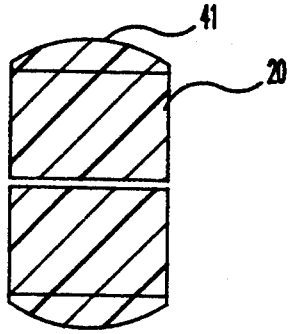
FIG. 3A is a cross section of a side view of the concentric collar portion of the present invention.
Figure 3B:
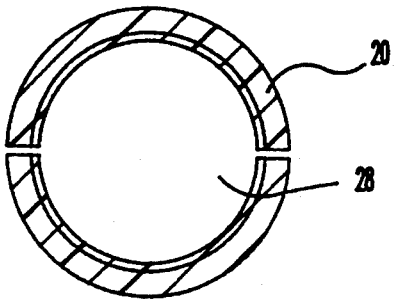
FIG. 3B is a frontal view of the concentric collar of the present invention.

FIGS. 3A and 3B show in cross sectional and frontal views respectively, the convex form at their outer diameter 41 and cylindrical bore 28. Collar 20 is concentric about the axis of its bore 28.

Figure 3C:
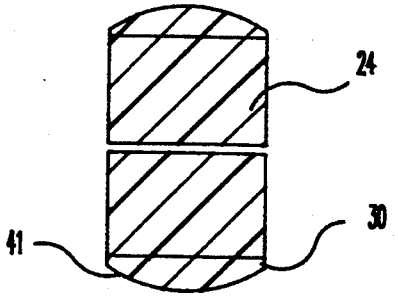
FIG. 3C is a cross section of a side view of an eccentric collar portion of the present invention.
Figure 3D:
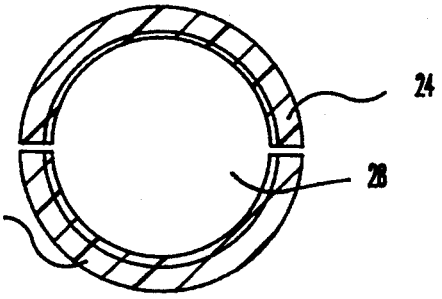
FIG. 3D is a frontal view of an eccentric collar of the present invention.

FIGS. 3C and 3D show in cross sectional and frontal views respectively, the convex form at their outer diameter 41 and cylindrical bore 28. Collar 24 is eccentric about the axis of it's bore 28. Lobe 30 is formed by the eccentricity.

Figure 3E:
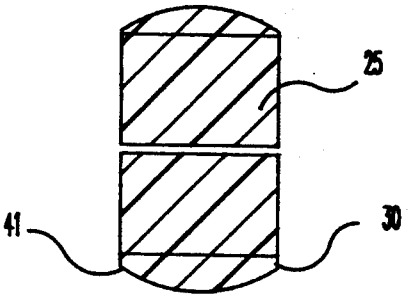
FIGS. 3E and 3F are respectively the same as FIGS. 3C and 3D., but showing a greater amount of eccentricity.
Figure 3F:
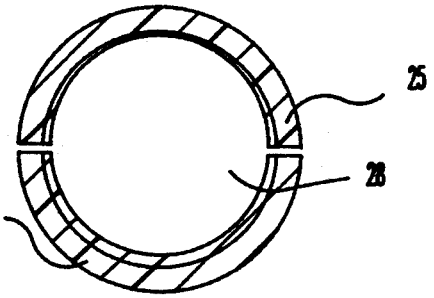

FIGS. 3E and 3F show in cross sectional and frontal views respectively, the convex form at their outer diameter 41 and cylindrical bore 28. Collar 25 is eccentric about the axis of it's bore 28 and has a greater amount of axial offset that of collar 24, FIGS. 3C and 3D. The outer diameter and convex radius 41 in FIGS. 3A through 3F is common and the cylindrical bore 28 is uncommon. Lobe 30 is formed from the eccentricity.

Figure 4:
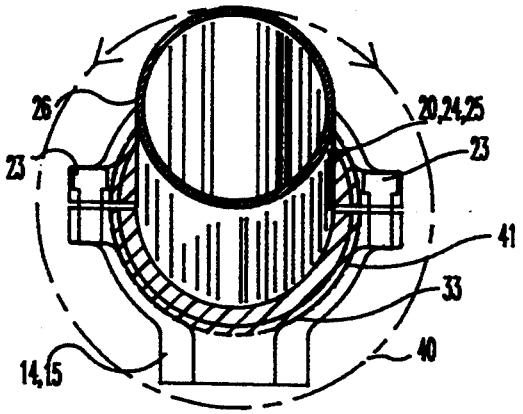
FIG. 4 is a frontal elevation of the mounting ring assembly and cross section of the frontal elevation of an optical sight and demonstrating it's rotational capabilities.

FIG. 4 illustrates an assembly of the mounting ring 14,15 with it's collar 20,24,25 in place about the optical sight 26 tube from a frontal perspective with the sectioned optical sight 26 tube tilted in a vertical plane. The tube of the optical sight 26 is sectioned to better display how the it can rotate along with the collar 20,24,25 within the mounting ring 14,15 about an orbit 40 without binding the optical sight 26 tube. The mounting ring collar 20,24,25 has formed on it a convex radiused surface 41 and is shown seated in a concave annular radiused seat 33 of the optical sight mounting ring. The top and bottom portions of the optical sight mounting ring 14,15 are attached by two optical sight mounting ring screws 23 holding the optical sight mounting ring 14,15 collar 20,24,25 about the optical sight tube 26. As the screws 23 are loosened, the collar 20,24,25 and optical sight 26 can be rotated within the optical sight mounting ring 14,15.

Figure 5A:
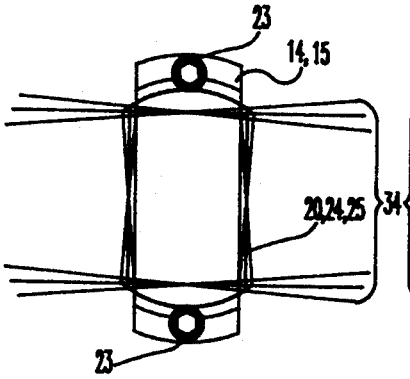
FIG. 5A is a top elevation of FIG. 4.
Figure 5B:
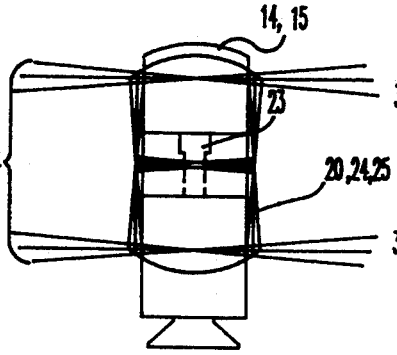
FIG. 5B is a side elevation of FIG. 4.

FIGS. 5A and 5B display varrying amounts of movement 34 of the optical sight 26 FIG. 4 tube and collar 20,24,25 as seen from top in FIG. 5A and side views in FIG. 5B when held in the mounting ring 14,15. Security of the optical sight 26 FIG. 4 is realized when mounting ring screws 23 are tightened about the collar 20,24,25 and the collar about the optical sight 26 FIG. 4 tube.

Figure 6:
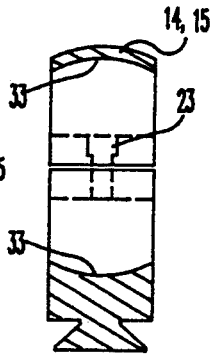
FIG. 6 is a side sectional view of a mounting ring of the present invention.
Figure 7A:
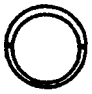
FIG. 7A through 7J are frontal elevations of the eccentric collars or "third members" shown in various rotational combinations.
Figure 7B:
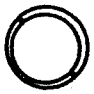
Figure 7C:
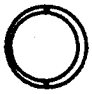
Figure 7D:
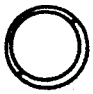
Figure 7E:
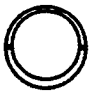
Figure 7F:
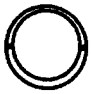
Figure 7G:
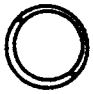
Figure 7H:
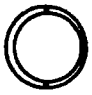
Figure 7I:
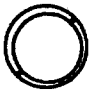
Figure 7J:
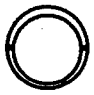

FIG. 6 is a side sectional view of a typical mounting ring 14,15 wherein can be seen a concave annular seat 33 which locates collar 20,24,25, against the convex radius 41 FIGS. 3A through 3F allowing unlimited free rotation of the collar. Mounting ring screws 23 apply force against the collars 20,24,25 hence the optical sight 26 tube, securing the entire assembly.

FIGS. 7A through 7J illustrates an end view elevation of the eccentric collars 24,25 FIGS. 3C through 2F which demonstrates a brief few of the combinations possible when mounted in tandem along the optical sight 26 FIG. 1 and within two or more mounting rings 14,15 FIG. 6 and directing the tube of the optical sight 26 FIG. 1 in the desired direction opposed to the lobe 30 FIGS. 3C and 3E of the collar 24,25 FIGS. 3C and 3E. The tube of the optical sight 26 FIG. 1, having cylindrical walls mate with the bore 28 FIGS. 3A through 3F of the collars 20,24,25 FIGS. 3A through 3F which is not movable, but the convex radius 41 FIGS. 3A through 3F of the collar 20,24,25 FIGS. 3A through 3F allows rotation, seating and holding within the mounting ring 14,15 FIG. 6 concave annular seat 33.

Figure 8A:
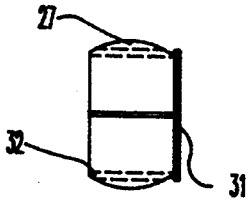
FIG. 8A is a side view of an optional, finger accessible, third member collar.
Figure 8B:
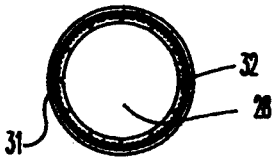
FIG. 8B is a frontal view of an optional, finger accessible, third member collar.

Turning now to FIGS. 8A and 8B, respective side and frontal views are seen of an optional collar 27 to collars 20,24,25 FIGS. 3A through 3F which avails a finger accessible knurled extension 31 designed primarily for frequent changing of the rotation. Numeral 32 points out serrations in the collar 27 paralleling the axis of the bore 28 FIG. 8B allowing flexing of the material comprising the collars 20,24,25, FIGS. 3A through 3F and 27 FIG. 8B around the optical sight 26 FIG. 4 tube while remaining intact as a single part.

Figure 9A:
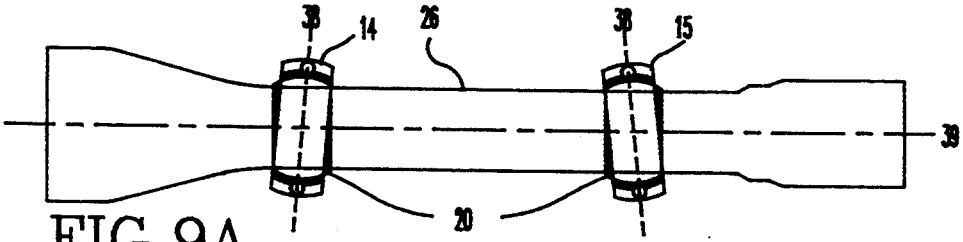
FIGS. 9A and 9B are top views of an optical sight and it's mounting rings and collars of the present invention, demonstrating the mounting system's versatility.

FIG. 9A is a top view of an optical sight 26 in assembly with it's mounting rings 14,15 and collars 20. An axis 38 is drawn bisecting the major diameter of the mounting rings 14,15 to demonstrate how misalignment among the several members of the entire assembly functions without placing stress on the optical sight 26. An optical sight 26 axis 39 is drawn for angular comparison. The figure illustrates misalignment while the lower is symmetric in all aspects.

Figure 9B:
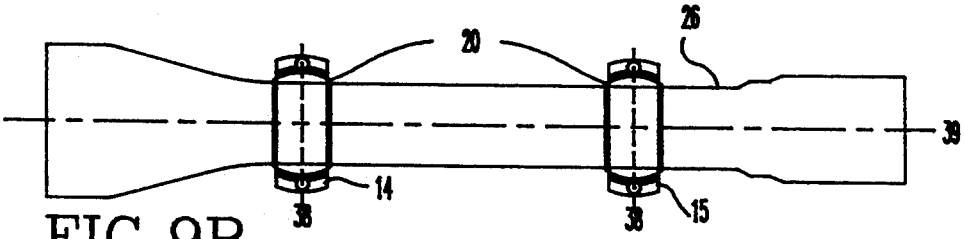

FIG. 9B replicates the FIG. 9B where the several members are symmetrically aligned.

Figure 10A:
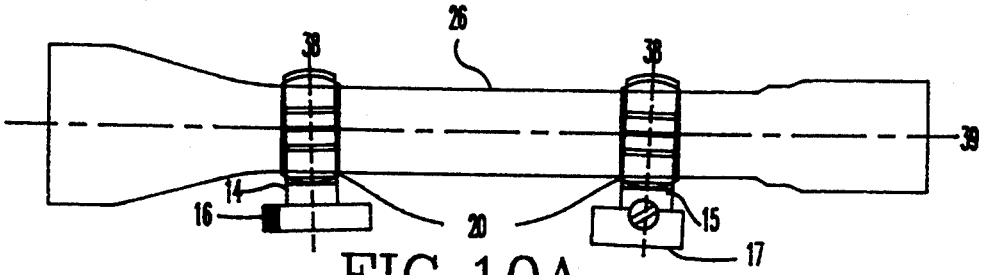
FIGS. 10A and 10B are side views of an optical sight, it's mounting system of all three members, demonstrating it's versatility.
Figure 10B:
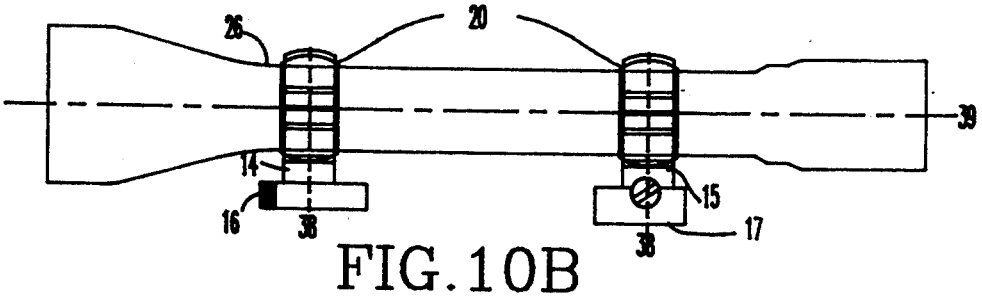

FIGS. 10A and 10B replicate FIGS. 9A and 9B from a side view perspective and additionally shows mounting bases 16,17 fixed to their mounting rings 14,15. FIG. 10A illustrates how the misalignment is compensated when dimensional variations occur when attached to an optically sighted gun FIG. 1 numeral 18. FIG. 10B is symmetrically correct.

Figure 11:
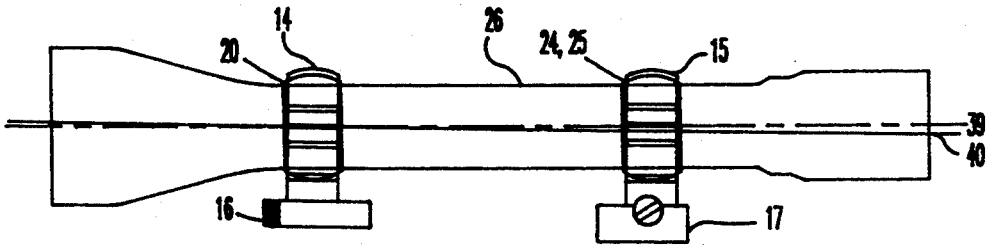
FIG. 11 is an additional view of FIGS. 10A and 10B with axial and line of sight added for reference.

FIG. 11 is provided to demonstrate the eccentric collars 24,25 in use with the required supporting members mounting rings 14,15, mounting bases 16,17 and optical sight 26. Numeral 40 represents the optical sight 26 axis 39 prior to rotation of the eccentric collar 24,25. This vertical adjustment has been made to raise the path of a projectile fired form the optical sight 26 mounted gun, FIG. 1, 18 to rise above line of sight without changing the mounting rings 14,15 or mounting bases 16,17 or adjustment of the internal members of the optical sight 26. By using the same demonstrated principle, horizontal or eccentric adjustments are accomplished.

Figure 12:
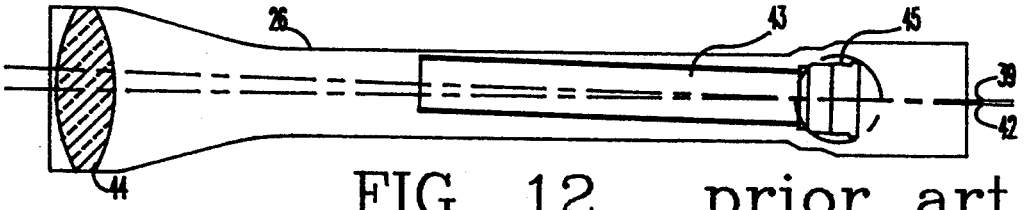
FIG. 12 prior art
FIG. 12 is a sectional side view of a typical optical sight, it's objective lens and erector guide tube.

FIG. 12, prior art, depicts a side elevation of a typical optical sight 26 with only two of it's basic members, the objective lens 44 and the erector lens guide tube 43. The erector tube 43 pivots about it's fixed pivot point 45 and is centered with other members of the lens group. A drawn serrated line 39 represents the axis of the optical sight 26 tube whereon all the optical members are centered to achieve optimum optical quality. A second serrated drawn line 42 represents the axis and light path of the erector tube 43. As can be seen, the light path 42 is directed to fall on the objective lens 44 off it's center or optimum optical position causing distortion of the object being viewed. By placement and/or adjustment of the eccentric collar/s FIGS. 3,11 numerals 24,25 within the mounting rings FIGS. 1,2,11 numerals 14,15, the optical sight 26 can be adjusted to effect proximal restoration of the axises 39,42 of the erector tube 43 and optical sight 26 hence centering on the optimum optical point of the objective lens 44.

Figure 13:
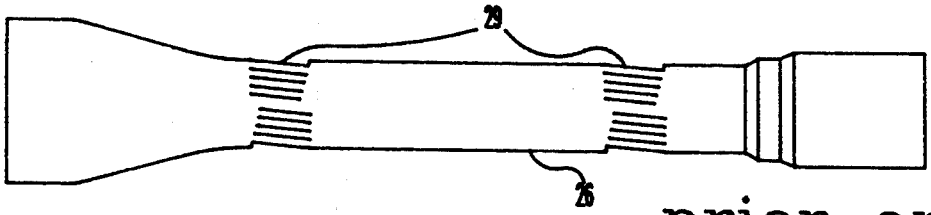
FIG. 13 prior art
FIG. 13 is a side view of a typical optical sight referring to it's damage as a result of prior art.

FIG. 13 reflects an example of the physical damage caused to the optical sight 26 tube at the locations 29 of fixed mounting rings. These stress points 29 appear in direct relationship to misalignment of any of the mounting members of the prior art. Conversely, by use of the preferred embodiment FIGS. 2, 3, 8, numerals 14,15,20,24,25 and 27 in proper assembly, the condition 29 is eliminated and optimum optical position FIG. 12 numeral 39 secured.

From the foregoing, there is shown and described a new and novel device and method which accomplishes the objectives and advantages of the invention plus many other advantages. It is apparent from a study of the patent application that changes may be made in the various parts and their arrangement as well as the method disclosed herein to provide other modifications. The applicant is not to be limited to the exact embodiments shown and described herein which are given by the way of illustration only.

Having described my invention, I claim:

1. An optical sight mounting system for a firearm comprising:

a pair of mounting ring means for mounting an optical sight to a firearm, each of said mounting ring means having an inner surface forming a concave annular seat;

means for adjusting an optical sight independently within at least one of said pair of mounting ring means, said independent adjusting means including first and second aligning collars, each aligning collar having an outer convex annular surface for mating with a said concave annular seat, said aligning collars further comprising a bore for reception of an optical sight therein, said first aligning collar having an eccentric portion formed between said outer convex annular surface and said bore, wherein an optical sight is permitted to be independently adjusted radially in at least one of said pair of mounting ring means and universally pivoted within each mounting ring means, thereby permitting the axis of the optical sight to be aligned with the axis of a barrel of the firearm.

2. The optical sight mounting system of claim 1, wherein said second aligning collar comprises a concentric portion formed between said outer convex annular surface and said bore.

3. The optical sight mounting system of claim 1, wherein said second aligning collar comprises an eccentric portion formed between said outer convex annular surface and said bore.

4. The optical sight mounting system of claim 3, wherein said eccentric portion of said second aligning collar has an eccentricity substantially equal to the eccentricity of the eccentric portion of said first aligning collar.

5. The optical sight mounting system of claim 3, wherein said eccentric portion of said second aligning collar has an eccentricity different from the eccentricity of the eccentric portion of said first aligning collar.

6. The optical sight mounting system of claim 1, wherein each of said adjusting collars are of two-piece construction.

7. The optical sight mounting system of claim 6, wherein each of said pair of mounting ring means further comprises an upper portion and a lower portion, said upper and lower portions being mutually attached by mounting screws, said mounting screws further serving to clamp a said aligning collar therein.

8. The optical sight mounting system of claim 1, wherein each of said pair of mounting ring means further comprises an upper portion and a lower portion, said upper and lower portions being mutually attached by mounting screws, said mounting screws further serving to clamp a said aligning collar therein.

9. The optical sight mounting system of claim 1, wherein at least one of said first and second adjusting collars further comprises finger accessible extension means for permitting rotation of said at least one of said first and second adjusting collars thereby changing the direction of axial offset of said optical sight.

10. The optical sight mounting system of claim 1, wherein each of said pair of mounting ring means is adapted for attachment to a fixed dovetail firearm mounting base.

11. The optical sight mounting system of claim 1, wherein each of said pair of mounting ring means is adapted for attachment to a rotary dovetail firearm mounting base.

12. The optical sight mounting system of claim 1, wherein a third aligning collar is provided, said first, second, and third aligning collars being interchangeable within said pair of mounting ring means; said second aligning collar comprising a concentric portion formed between said outer convex annular surface and said bore of said second aligning collar, said third aligning collar comprising an eccentric portion formed between an outer convex annular surface and a bore of said third aligning collar.

13. The optical sight mounting system of claim 12, wherein said third aligning collar eccentric portion has an eccentricity different from the eccentricity of the eccentric portion of said first aligning collar.

* * * * *